US005727416A

United States Patent [19]

Allgoewer

[11] Patent Number: 5,727,416

[45] Date of Patent: Mar. 17, 1998

[54] TRANSFER DEVICE IN A METAL-FORMING MACHINE, PARTICULARLY A TRANSFER PRESS

[75] Inventor: Gerhard Allgoewer, Goeppingen, Germany

[73] Assignee: Schuler Pressen GmbH & Co., Germany

[21] Appl. No.: 586,910

[22] PCT Filed: May 26, 1995

[86] PCT No.: PCT/DE95/00712

§ 371 Date: May 13, 1996

§ 102(e) Date: May 13, 1996

[87] PCT Pub. No.: WO95/32822

PCT Pub. Date: Dec. 7, 1995

[30] Foreign Application Priority Data

May 26, 1994 [DE] Germany ..... 44 18 417.4

[51] Int. Cl.[6] ..... B21D 43/05

[52] U.S. Cl. ..... 72/405.11; 72/405.1; 72/405.01

[58] Field of Search ..... 72/405.09–405.12, 72/405.01

[56] References Cited

U.S. PATENT DOCUMENTS 3,596,498 8/1971 Bradlee .

4,995,505 2/1991 Takahashi ..... 72/405.1

FOREIGN PATENT DOCUMENTS

| | | | |
|---|---|---|---|
| 0 315 381 A2 | 5/1989 | European Pat. Off. . | |
| 0 621 093 A1 | 3/1994 | European Pat. Off. . | |
| 37 25 310 A1 | 2/1988 | Germany . | |
| 1-237030 | 9/1989 | Japan . | |
| 224833 | 9/1990 | Japan | 72/405.11 |
| 284730 | 11/1990 | Japan | 72/405.09 |
| 221228 | 9/1991 | Japan | 72/405.01 |
| 220124 | 8/1992 | Japan | 72/405.1 |
| 177277 | 7/1993 | Japan | 72/405.1 |
| 2 243 134 | 10/1991 | United Kingdom . | |

*Primary Examiner*—Daniel C. Crane

*Attorney, Agent, or Firm*—Evenson, McKeown, Edwards & Lenahan, P.L.L.C.

[57] ABSTRACT

A transfer device in a metal forming machine, particularly a transfer press, bulky-part transfer press, press facility and the like, is provided with a slide which can be moved up and down by means of driving devices for the metal forming of sheet metal parts 16, having sliding tables for the tool change, having a cam drive for a transfer movement of connecting rods to which travelling carriages 2, 15 are pivotally connected which travel on transfer rails 3. Two opposite travelling carriages 2, 15 respectively are connected with one another by means of at least one cross traverse 12. On each side, the cross traverse 12 is connected with the respective travelling carriages 2, 15 by way of a lifting and lowering device 1.

11 Claims, 4 Drawing Sheets

TRANSFER DEVICE IN A METAL-FORMING MACHINE, PARTICULARLY A TRANSFER PRESS

This application is a 371 of PCT/DE95/00712, filed May 26, 1995.

BACKGROUND AND SUMMARY OF THE INVENTION

The present invention relates to a transfer device in a metal-forming machine, and more particularly to a transfer press having a slide configured to move up and down via driving devices for metal forming of sheet metal parts, sliding tables for tool change, a cam drive for transfer movement of connecting rods to which travelling carriages are pivotally connected which travel on transfer rails, opposed travelling carriages respectively operatively connected by at least one cross traverse.

Transfer presses, bulky-part transfer presses, press facilities are metal-forming machines in which sheet metal parts are formed by process steps, such as drawing and stamping. For this purpose, the presses have at least one slide on which a tool or a tool set (upper tool) is fastened which interacts with a tool or tool set (lower tool) in the press bed or on a sliding table. The slides can be moved up and down by driving devices of the press. In the areas between the frames and the presses arranged behind them—the so-called no-load stages—, intermediate depositing devices are arranged. The changing of the tools or tool sets takes place by sliding tables which can be moved out of the press for this purpose.

For bridging the described no-load stages between the presses, transfer devices are known, in which case travelling carriages are provided on transfer rails which extend in parallel to the conveying direction of the sheet metal parts, in which case two mutually opposite travelling carriages are, in each case, connected with one another by at least one cross-traverse.

On the cross-traverses, devices are mounted for receiving and transporting the sheet metal parts machined in the press or to be machined in the following press. The above-mentioned devices may be constructed, for example, as grippers or suction devices.

In order to lift the sheet metal part out of a press or to place it in the tool of a following press, the transfer device must carry out, among other movements, a movement perpendicularly to the floor that is, a lifting or lowering movement.

In the case of known transfer devices, the lifting and lowering movement takes place by fact that the whole transfer rail or individual sections of the transfer rail are lifted or lowered with the travelling carriages arranged thereon. The lifting movement is controlled by at least one cam plate which is moved synchronously together with other cam plates in order to thus be able to synchronously move all movable parts of the transfer device.

The above-described state of the art has the disadvantage that the manufacturing and mounting expenditures are relatively high because a plurality of individual parts must be manufactured and mounted.

Another disadvantage are the many moved masses which, during a lifting movement of the transfer device, must all be accelerated and decelerated.

It is therefore an object of the present invention to provide a transfer device which can be manufactured and mounted in a simple manner and at reasonable cost and which has fewer masses moved during a lifting movement.

According to the invention, this object is achieved by providing that the cross traverse is connected on each side by a lifting and lowering device with the respective travelling carriages.

As a result of the arrangement of a lifting and lowering device on each individual travelling carriage, it is no longer necessary to lift the whole transfer rail or sections thereof with all components arranged on the transfer rail so that significantly less mass must be accelerated which has an advantageous effect on the entire dimensioning of the transfer device.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
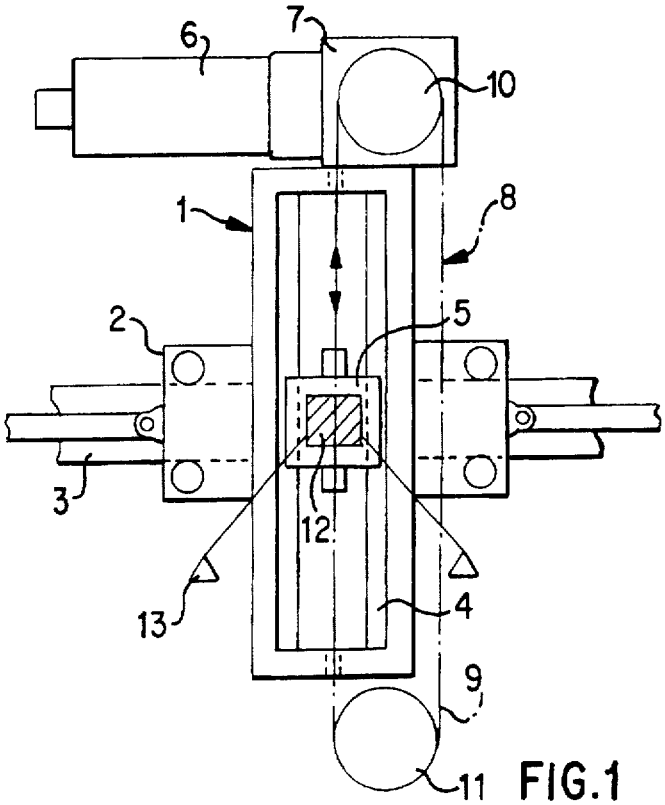
FIG. 1 is an elevational view of a first embodiment of a lifting and lowering device.

FIG. 1 shows a lifting and lowering device 1 which is arranged on a travelling carriage 2 which is displaceably disposed on a transfer rail.

Perpendicularly with respect to the longitudinal axis of the transfer rail 3, a linear guide 4 is mounted on the travelling carriage 2 for guiding a sliding block 5.

The sliding block 5 is moved by a motor 6 which, via a gear 7, which may be constructed as an angular gear or as a worm gear, drives a torque transmitting device 8 which, in the present embodiment, is constructed as a synchronous belt drive.

The ends of the toothed belt 9 of the torque transmitting device 8 are both fastened on the sliding block 5. In this case, the deflection of the toothed belt 9 takes place by way of toothed belt wheels 10, 11, with the toothed belt wheel 10 being arranged on the output shaft of the gear 7.

When the motor 6 is driven, the sliding block 5 is moved by the gear as well as the toothed belt 9, specifically in the lifting direction of the transfer device, a cross traverse 12 mounted on the sliding block 5 simultaneously being moved along.

On the cross traverse 12, grippers or suction devices 13 (see FIG. 3) are arranged which can receive and hold a sheet metal part.

Figure 2:
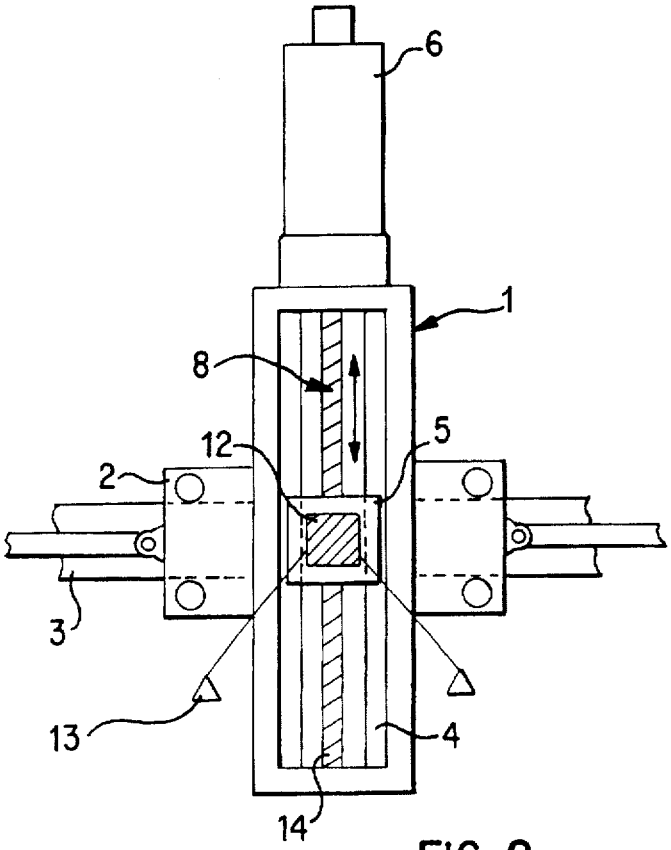
FIG. 2 is a second embodiment of a lifting and lowering device.

FIG. 2 illustrates another embodiment of the lifting and lowering device 1 according to FIG. 1.

In particular, the lifting and lowering device 1 is also arranged on a travelling carriage 2 which can be moved on the transfer rail 3. The sliding block 5 is also disposed in a linear guide 4; however, the torque transmitting device 8 is constructed as a ball rolling spindle 14.

The ball rolling spindle 14 is moved directly by a motor 6 so that the interposition of a gear between the motor 6 and the ball rolling spindle 14 is superfluous.

As described in connection with FIG. 1, a cross traverse 12 with suction devices 13 is mounted on the sliding block 5.

Figure 3:
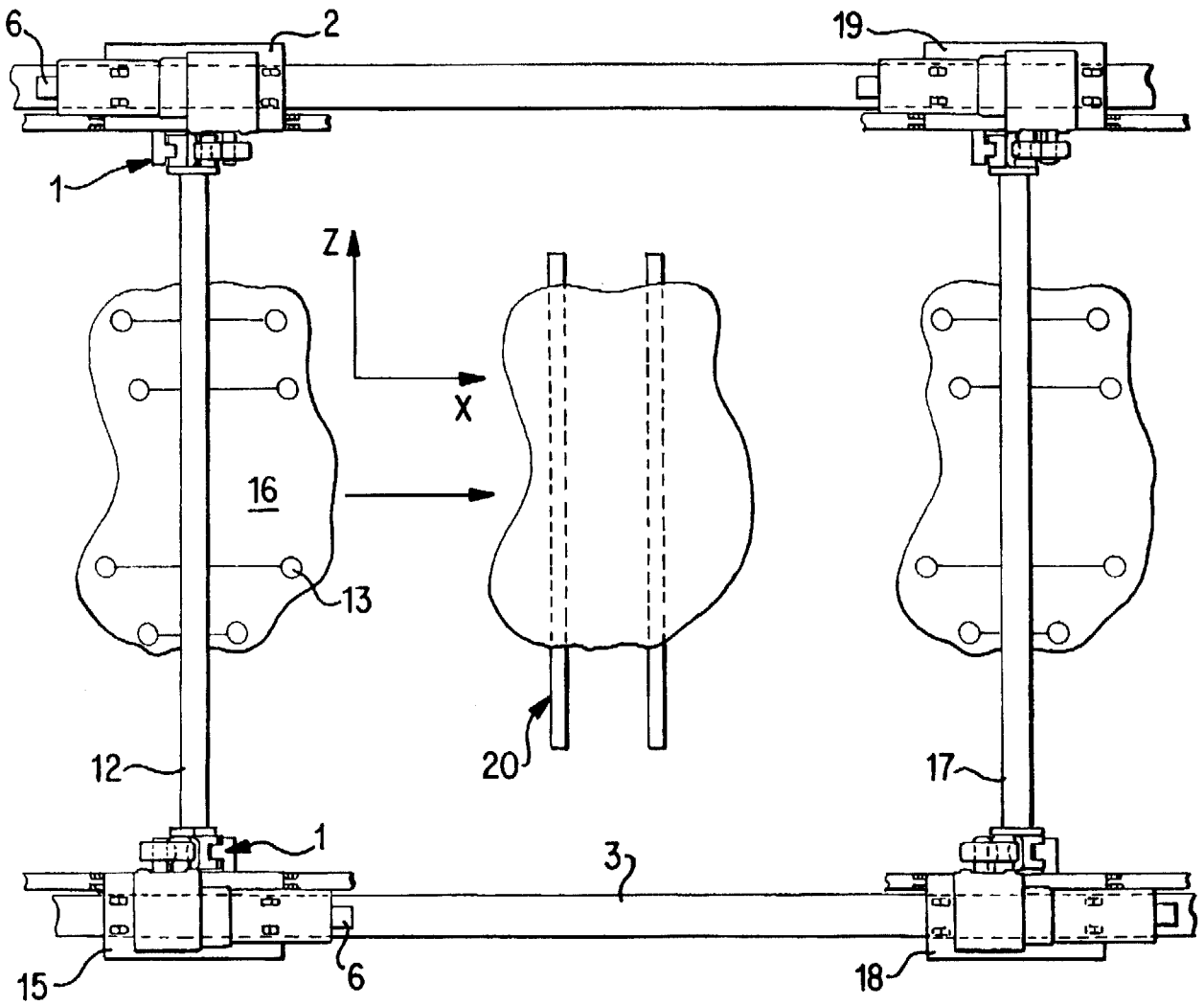
FIG. 3 is a top view of a transfer device according to the invention.

FIG. 3 is a top view of a transfer device which has travelling carriages 2, 15 which are provided with lifting and lowering devices 1. The travelling carriages 2, 15 are guided on the transfer rails 3 in a linearly movable manner.

Between the mutually opposite travelling carriages 2 and 15, the cross traverse 12 is arranged on which, in turn, suction devices 13 are mounted for receiving and transporting a sheet metal part 16.

Between the cross traverse 12 and a cross traverse 17 which, in turn, are connected with a travelling carriage 18, 19, an intermediate depositing device 20 is arranged.

During the transport of the sheet metal part 16, the latter is removed from the first press by the suction devices 13 on the cross traverse 12 and is deposited on the intermediate depositing device 20. Subsequently, the sheet metal part 16 is taken up by the suction devices on the additional cross traverse 17, that is, the cross traverse which follows, and is placed into a following or downstream press.

The intermediate depositing device 20 is freely programmable and can be adjusted in several axes.

By way of the lifting and lowering devices 1, which are arranged on the travelling carriages 2, 15, the sheet metal part 16 is moved in a direction perpendicularly to the xz-plane illustrated in FIG. 3.

So that the lifting and lowering devices 1 on the travelling carriages 2, 15 are operated simultaneously and uniformly, the drives 6 of the individual lifting and lowering devices are electrically coupled so that the lifting movement takes place synchronously.

Furthermore, in FIG. 3, the z and x directions are entered into a system of coordinates, in which case the directions determined in the system of coordinates are to be used in the following.

As known, the cross traverses 12, 17 can be rotated about their longitudinal axis. For this purpose, for example, a laterally arranged driving motor (not shown) may be provided which has a worm gear or an angular gear. As a result, the rotating movements of the cross traverses 12, 17 can be carried out in a simple manner.

Figure 4:
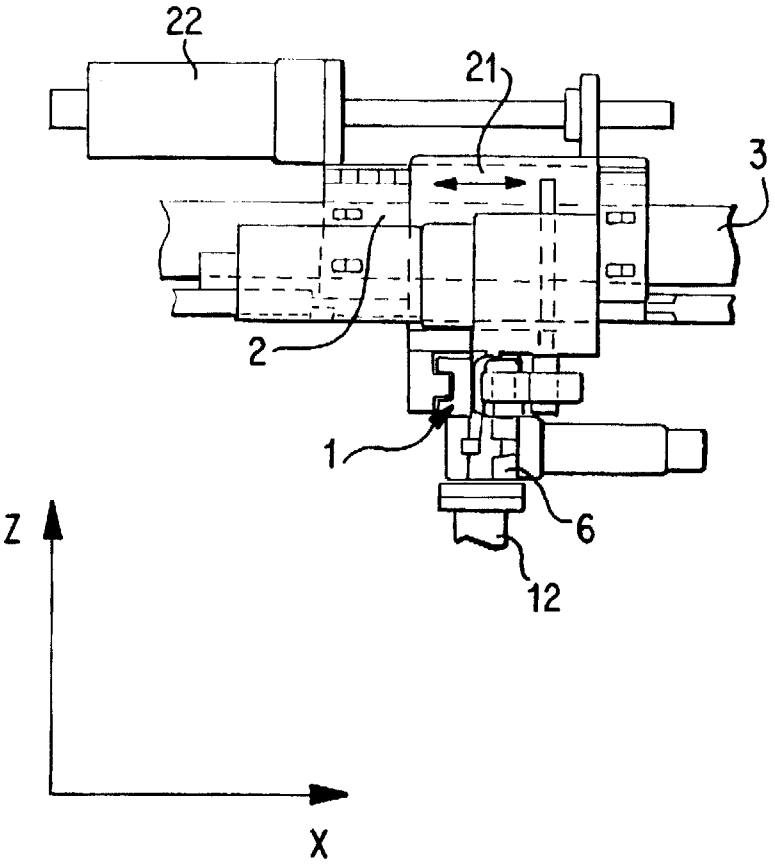
FIG. 4 is a top view of a travelling carriage by way of which a linear compensating movement can be carried out.

FIG. 4 is a top view of a travelling carriage 2 which, in addition, is provided with an adjusting member 21, in which case the adjusting member can carry out a compensating movement of the cross traverse 12 in the x-direction, that is, parallel to the transport direction of the sheet metal parts 16.

In this case, the lifting and lowering device 1 is arranged on the adjusting member 21, the adjusting member 21 having a separate drive 22.

Figure 5:
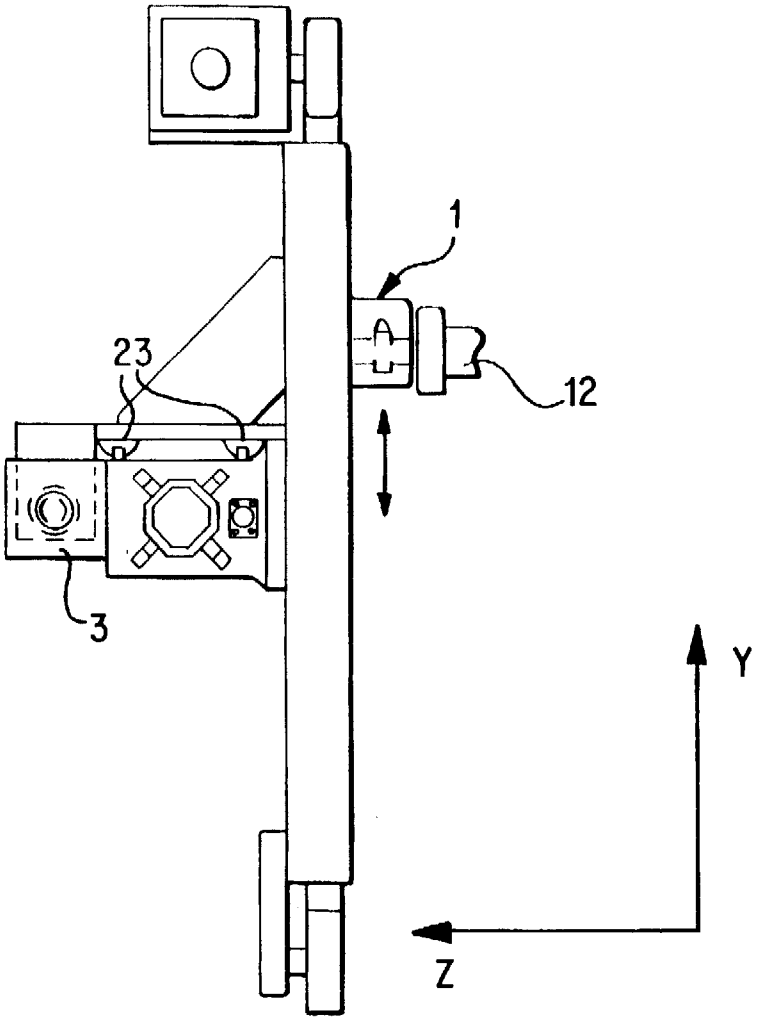
FIG. 5 is a side view of the arrangement according to FIG. 4.

As illustrated in FIG. 5, the adjusting member 21 is guided in a linear guide 23 permitting a linear movement of the adjusting member 21 with all components mounted thereon. In the present embodiment, the linear guide is constructed as a guide rail 23.

In order to achieve a simultaneous and uniform movement of the adjusting members 21 on mutually opposite travelling carriages 2, 15, the drives 22 of the adjusting members 21 are synchronized.

However, the adjusting member 21 may also be mounted on the lifting and lowering device 1; that is, on the sliding block 5, an intermediate member (not shown) is arranged on which guide rails 23 are mounted. The adjusting member 21 which is adjoined by the cross traverse 12 is, in turn, guided in the guide rails.

Figure 6:
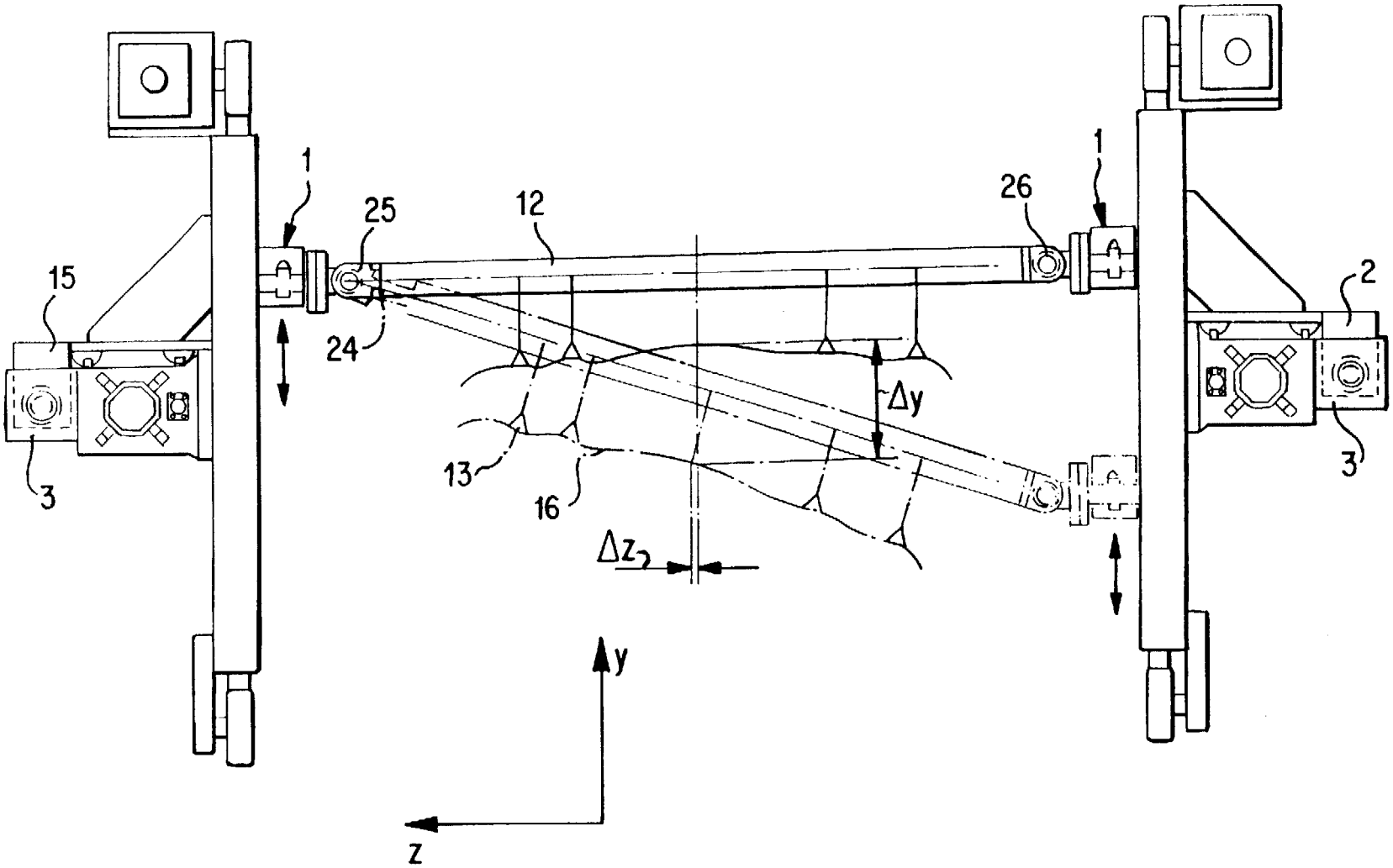
FIG. 6 is a side view of another embodiment of the transfer device according to the invention.

FIG. 6 illustrates another embodiment of the transfer device.

In this case, the lifting and lowering devices 1 of mutually opposite travelling carriages 2, 15 are not driven simultaneously or in the same direction so that the sliding blocks 5 of the respective lifting and lowering device 1 are not at the same level.

In particular, this may be an advantage when a sheet metal part 16 which hangs on the suction devices 13 is to be swivelled about an axis extending parallel to the transport direction of the sheet metal part 16.

However, in this case, the distance between the two lifting and lowering devices 1 is extended by an amount $\Delta z$; that is, the cross traverse 12 must carry out a length compensation by the amount $\Delta z$. This takes place by providing a length compensating device in the cross traverse 12, which length compensating device is constructed as a telescopic tube 24 in the present embodiment.

In this case, the cross traverse 12 is hollow in the interior, and another tube or a rod is fitted into the hollow interior of the cross traverse 12, and the tube or the rod is slidably disposed in the cross traverse 12.

In order to avoid deformations of the cross traverse 12 in the case of movements of the lifting and lowering devices 1 in the opposite direction, the ends of the cross traverse 12 are provided with joints 25, 26 which permit the different positions of the lifting and lowering device 1 in the y-direction and the resulting position change of the cross traverse 12.

Of course, the travelling carriages 2, 15, in addition, may also be provided with the adjusting member 21 described in FIGS. 4 and 5, which is illustrated on the embodiment according to FIG. 6. If joints 25, 26 are constructed as ball joints, a synchronization of the driving motors 22 in the x-direction (see FIGS. 4 and 5) is not longer necessary.

As a result of the described transfer device, the intermediate depositing device 20 between successive presses may have a simpler construction. Although, as previously, the intermediate depositing device 20 has to carry out compensating movements, these are limited to compensating movements $\Delta z$ with respect to a swivel movement about the x-direction. The previous height compensation in the y-direction by the intermediate depositing device 20 will now be carried out by the illustrated lifting and lowering device 1 ($=\Delta y$). In the case of the embodiment according to FIG. 6, the tilt compensating movement on the intermediate depositing device 20 may at the same time be omitted.

As a result of the adjusting members 21, which are illustrated in FIGS. 4 and 5, the longitudinal axis (=x-direction) on the intermediate depositing device 20 is omitted. By way of the worm gear or angular gear illustrated in FIG. 4, the swivel movement about the z-direction may be omitted on the intermediate depositing device 20.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. Transfer device for a metal forming machine, comprising a plurality of lifting and lowering devices operatively arranged to move up and down, transfer rails, opposed travelling carriages carrying respective ones of the lifting and lowering devices and arranged to move along the transfer rails, and at least one cross traverse operatively associated with the lifting and lowering devices on the opposed travelling carriages, wherein on each of the opposed travelling carriages, an adjusting member is operatively arranged to carry out a linear compensating movement parallel to a transport direction of sheet metal parts along the transfer device the lifting and lowering devices have a separate drive, a slidable block arranged to be moved by the separate drive via a torque transmitting device, and the sliding block is disposed in the adjusting member.

2. Transfer device according to claim 1, wherein the adjusting member is arranged on the sliding block.

3. Transfer device according to claim 2, wherein an intermediate member which carries the linear guide is arranged on the sliding block.

4. Transfer device according to claim 1, wherein a length compensating device is provided in the at least one cross traverse.

5. Transfer device according to claim 4, wherein the length compensating device is a telescopic tube.

6. Transfer device according to claim 3, wherein the cross traverse is connected on each end by at least one joint with one of the sliding block and the intermediate member.

7. Transfer device for a metal forming machine, comprising a plurality of lifting and lowering devices operatively arranged to move up and down, transfer rails, opposed travelling carriages carrying respective ones of the lifting and lowering devices and arranged to move along the transfer rails, and at least one cross traverse operatively associated with the lifting and lowering devices on the opposed travelling carriages, wherein on each of the opposed travelling carriages, an adjusting member is operatively arranged to carry out a linear compensating movement parallel to a transport direction of sheet metal parts along the transfer device at least the adjusting members of opposite travelling carriages are synchronously driven.

8. Transfer device in a metal forming machine, comprising one of a transfer press, large-piece transfer press, and press system, having driving devices, a slide arranged to be moved up and down via the driving devices for metal forming of sheet metal parts, a cam drive for a transfer movement of connecting rods to which travelling carriages are pivotally connected which travel on transfer rails, two opposed travelling carriages respectively being connected with one another by at least one cross traverse, a lifting and lowering device for connecting each side of the cross traverse with the respective travelling carriages and a length compensating device provided in the cross traverse.

9. Transfer device according to claim 8, wherein the length compensating device is a telescopic tube.

10. Transfer device according to claim 8, wherein at least one joint connects ends of the cross traverse with a sliding block or the intermediate member.

11. Transfer device according to claim 10, wherein the length compensating device is a telescopic tube.

* * * * *